US007254534B2

(12) United States Patent
Ansorge et al.

(10) Patent No.: US 7,254,534 B2
(45) Date of Patent: Aug. 7, 2007

(54) METHOD AND DEVICE FOR ENCODING WIDEBAND SPEECH

(75) Inventors: Michael Ansorge, Hauterive (CH); Giuseppina Biundo Lotito, Neuchatel (CH); Benito Carnero, Santa Clara, CA (US)

(73) Assignee: STMicroelectronics N.V., Amsterdam (NL)

( * ) Notice: Subject to any disclaimer, the term of this patent is extended or adjusted under 35 U.S.C. 154(b) by 934 days.

(21) Appl. No.: 10/622,021

(22) Filed: Jul. 17, 2003

(65) Prior Publication Data

US 2005/0075867 A1 Apr. 7, 2005

(30) Foreign Application Priority Data

Jul. 17, 2002 (EP) ..... 02015918

(51) Int. Cl.
*G10L 19/12* (2006.01)

(52) U.S. Cl. ..... 704/220

(58) Field of Classification Search ..... 704/220
See application file for complete search history.

(56) References Cited

U.S. PATENT DOCUMENTS

| | | | | |
|---|---|---|---|---|
| 3,391,763 | A | 7/1968 | Severson | |
| 5,664,055 | A * | 9/1997 | Kroon | 704/223 |
| 5,717,825 | A * | 2/1998 | Lamblin | 704/223 |
| 5,787,390 | A * | 7/1998 | Quinquis et al. | 704/219 |
| 6,104,992 | A * | 8/2000 | Gao et al. | 704/220 |
| 6,260,669 | B1 | 7/2001 | Daudi | |
| 6,604,070 | B1 * | 8/2003 | Gao et al. | 704/222 |
| 6,735,567 | B2 * | 5/2004 | Gao et al. | 704/258 |

FOREIGN PATENT DOCUMENTS

| | | |
|---|---|---|
| EP | 0 512 853 | 11/1992 |
| EP | 0751494 | 1/1997 |
| GB | 1 403 828 | 8/1975 |

OTHER PUBLICATIONS

European Search Report, May 6, 2004.
IEEE, CH2977-7/91/0000-0241, 1991, pp. 241-244, "Pitch Sharpening for Perceptually Improved CELP, and the Sparse-Delta Codebook for Reduced Computation".
IEEE, CH2561-9/88/0000-0151, 1988, pp. 151-154, "Strategies for Improving the Performance of Celp Coders at Low Bit Rates".

* cited by examiner

*Primary Examiner*—Susan McFadden
(74) *Attorney, Agent, or Firm*—Lisa K. Jorgenson; Allen, Dyer, Doppelt, Milbrath & Gilchrist, P.A.

(57) ABSTRACT

The speech is sampled in such a way as to obtain successive voice frames each including a predetermined number of samples, and with each voice frame are determined parameters of a code-excited linear prediction model. The parameters include a long-term excitation digital word $v_i$ extracted from an adaptive coded directory LTD, and an associated long-term gain Ga, as well as a short-term excitation word cj extracted from a fixed coded directory STD and an associated short-term gain Gc. The product of the long-term excitation extracted word times the associated long-term gain is summed SM with the product of the short-term excitation extracted word times the associated short-term gain. The summed digital word is filtered in a low-pass filter FLCT having a cutoff frequency greater than a quarter of the sampling frequency and less than a half of the latter, and the adaptive coded directory is updated with the filtered word.

36 Claims, 7 Drawing Sheets

METHOD AND DEVICE FOR ENCODING WIDEBAND SPEECH

FIELD OF THE INVENTION

The invention relates to the encoding and decoding of wideband audio/speech, and in particular, to mobile telephones.

BACKGROUND OF THE INVENTION

In wideband, the bandwidth of the speech signal lies between 50 and 7000 Hz. Successive speech sequences sampled at a predetermined sampling frequency, for example 16 kHz, are processed in a CELP-type coding device using coded-sequence-excited linear prediction (for example, ACELP: "algebraic-code-excited linear-prediction"), well known to the person skilled in the art, and described in particular in recommendation ITU-TG 729, version 3/96, entitled "Coding of speech at 8 kbits/s by conjugate structure-algebraic coded sequence excited linear prediction". The main characteristics and operation of such a coder will now be briefly described while referring to FIG. 1, the person skilled in the art being able to refer for all useful purposes, for further details, to the above-mentioned recommendation G 729.

The prediction coder CD, of the CELP type, is based on the model of code-excited linear predictive coding. The coder operates on voice super-frames equivalent for example to 20 ms of signal and each comprising 320 samples. The extraction of the linear prediction parameters, i.e. the coefficients of the linear prediction filter also referred to as the short-term synthesis filter 1/A(z), is performed for each speech super-frame. On the other hand, each super-frame is subdivided into frames of 5 ms comprising 80 samples. Every frame, the voice signal is analyzed to extract therefrom the parameters of the CELP prediction model (i.e. in particular, a long-term excitation digital word $v_i$ extracted from an adaptive coded directory LTD, also dubbed "adaptive long-term dictionary", an associated long-term gain Ga, a short-term excitation word $c_j$, extracted from a fixed coded directory STD, also dubbed "short-term dictionary", and an associated short-term gain Gc).

These parameters are thereafter coded and transmitted. At reception, these parameters serve, in a decoder, to recover the excitation parameters and the predictive filter parameters. The speech is then reconstructed by filtering this excitation stream in a short-term synthesis filter.

Whereas the adaptive dictionary LTD contains digital words representative of tonal lags representative of past excitations, the short-term dictionary STD is based on a fixed structure, for example of the stochastic type or of the algebraic type, using a model involving an interleaved permutation of Dirac pulses. In the case of an algebraic structure, the coded directory, which contains innovative excitations also referred to as algebraic or short-term excitations, each vector contains a certain number of nonzero pulses, for example four, each of which may have the amplitude +1 or −1 with predetermined positions.

The processing means of the coder CD functionally includes first extraction means MEXT 1 intended to extract the long-term excitation word, and second extraction means MEXT 2 intended to extract the short-term excitation word. Functionally, these means are embodied for example in software fashion within a processor.

These extraction means comprise a predictive filter PF having a transfer function equal to 1/A(z), as well as a perceptual weighting filter PWF having a transfer function W(z). The perceptual weighting filter is applied to the signal to model the perception of the ear. Furthermore, the extraction means comprise means MSEM intended to perform a minimization of a mean square error. The synthesis filter PF of the linear prediction models the spectral envelope of the signal. The linear predictive analysis is performed every super-frame, in such a way as to determine the linear predictive filtering coefficients. The latter are converted into pairs of spectral lines (LSP: "Line Spectrum Pairs") and digitized by predictive vector quantization in two steps.

Each 20 ms speech super-frame is divided into four frames of 5 ms each containing 80 samples. The quantized LSP parameters are transmitted to the decoder once per super-frame whereas the long-term and short-term parameters are transmitted at each frame. The quantized and nonquantized coefficients of the linear prediction filter are used for the most recent frame of a super-frame, while the other three frames of the same super-frame use an interpolation of these coefficients. The open-loop tonal lag is estimated, for example, every two frames on the basis of the perceptually weighted voice signal. Next, the following operations are repeated at each frame.

The long-term target signal $X_{LT}$ is calculated by filtering the sampled speech signal s(n) by the perceptual weighting filter PWF. The zero-input response of the weighted synthesis filter PF, PWF is thereafter subtracted from the weighted voice signal so as to obtain a new long-term target signal. The impulse response of the weighted synthesis filter is calculated. A closed-loop tonal analysis using minimization of the mean square error is thereafter performed so as to determine the long-term excitation word $v_i$ and the associated gain Ga, via the target signal and of the impulse response, by searching around the value of the open-loop tonal lag.

The long-term target signal is thereafter updated by subtraction of the filtered contribution y of the adaptive coded directory LTD and this new short-term target signal $X_{ST}$ is used during the exploration of the fixed coded directory STD to determine the short-term excitation word $c_j$ and the associated gain $G_c$. Here again, this closed-loop search is performed by minimization of the mean square error. Finally, the adaptive long-term dictionary LTD as well as the memories of the filters PF and PWF, are updated via the long-term and short-term excitation words thus determined.

The quality of a CELP algorithm depends strongly on the richness of the short term excitation dictionary STD, for example an algebraic excitation dictionary. Whereas the effectiveness of such an algorithm is unquestionable for narrow bandwidth signals (300-3400 Hz), problems arise in respect of wideband signals.

It has been observed that even with a very rich dictionary, the speech encoding algorithm produces two types of problems:

1) totally inadequate overall quality of reconstructed speech (the reconstructed speech lacks presence, the energy level is highly variable, the timbre of the voice is hardly recognizable, etc.); and 2) a reconstructed signal corrupted by three kinds of noise:

- a harmonic noise at high frequency (comb-like noise),
- a considerable high-frequency noise, such as a quantization noise, and
- a noise at low frequency (rumbling noise), such as a straw broom struck on the ground at regular intervals.

An improvement in the overall quality of the speech could be obtained by partial or total elimination of such noise.

SUMMARY OF THE INVENTION

An object of the invention is to reduce the harmonic noise and the high frequency noise.

An object of the invention is also to remove the "whistling" type noise that mars voiced speech frames.

Another object of the invention is furthermore to independently control the short-term and long-term distortions.

The invention therefore provides a wideband speech encoding method in which the speech is sampled in such a way as to obtain successive voice frames each comprising a predetermined number of samples, and with each voice frame are determined parameters of a code-excited linear prediction model, these parameters comprising a long-term excitation digital word extracted from an adaptive coded directory, and an associated long-term gain, as well as a short-term excitation word extracted from a short-term dictionary and an associated short-term gain, and the adaptive coded directory is updated on the basis of the extracted long-term excitation word and of the extracted short-term excitation word.

According to a general characteristic of the invention, the product of the long-term excitation extracted word times the associated long-term gain is summed with the product of the short-term excitation extracted word times the associated short-term gain, the summed digital word is filtered in a low-pass filter having a cutoff frequency greater than a quarter of the sampling frequency and less than a half of the latter, and the adaptive coded directory is updated with the filtered word. The invention here uses a "total correction" filter which combines a filter for correcting the harmonic noise and a high frequency correction filter.

The invention thus allows an improvement in the quality during the voiced speech frames. Furthermore, the complexity of the encoder is reduced by merging the harmonic correction filter and the high frequency correction filter into a single filter.

The invention differs in particular from an approach described in an article by Kroon and Atal, entitled "Strategies for Improving the Performance of CELP Coders at Low Bit Rates", Proc., IEEE, Int. Conf. Acoustics, Speech, and Signal Processing, ICASSP'88, New York, USA, 1988, pages 151-154, which proposes a filtering of the adaptive dictionary performed on exit from this dictionary and not on entry in accordance with the invention.

Thus, the prefiltering of the adaptive dictionary according to the invention has, as compared with the post-filtering of the article by Kroon and Atal, the advantage that the filtering is taken into account during the minimization of the error performed for choosing the adaptive excitation at the next frame. This is not the case for the solution by Kroon and Atal, since the proposed filtering takes place on the chosen excitation. Hence, to take account of the filtering in the minimization of the error, it would then be necessary to increase the complexity.

According to a preferred embodiment, the summed word is filtered with a linear-phase finite impulse response digital filter having an order at least equal to 10. For example, when the sampling frequency is 16 kHz, the filter is a filter of order 20 having a cutoff frequency of the order of 6 kHz.

Although the quality of the speech is thus improved, the voiced speech frames still seem to be corrupted by a "whistling" type noise. This noise of high-frequency nature stems from the short-term excitation that introduces undesirable artefacts. Two types of approaches for solving this problem have already been proposed in the literature. A first approach, described for example in the article by Gerson and Jasiuk, entitled "Techniques for Improving the Performance of CELP-Type Speech Coders", IEEE, Journal on Selected Areas in Communications, Vol. 10, No 5, June 1992, pages 858-865, or else in the article by Miki et al., entitled "A Pitch Synchronous Innovation CELP (PSI-CELP) Coder for 2-4 kbit/s", Proc. IEEE Int. Conf. Acoustics, Speech, and Signal Processing, ICASSP'84, Adelaide, South Australia, 1994, Vol. II, pages 113-116, proposes that the short-term contribution be rendered periodic.

Another approach, described for example in the article by Taniguchi Johnson and Ohta, entitled "Pitch Sharpening for Perceptually Improved CELP, and the Sparse-Delta Codebook for Reduced Computation", Proc. IEEE Int. Conf. Acoustics, Speech, and Signal Processing, ICASSP'91, Toronto, Canada, 1991, pages 241-244, or in the article by Shoham, entitled "Constrained-Stochastic Excitation Coding of Speech at 4.8 kbit/s", Advances in Speech Coding, B. S. Atal, V. Cuperman, and A. Gersho, Eds., Dordrecht, The Netherlands, Kluwer, 1991, pages 339-348, proposes that the short-term gain be adaptively controlled.

The invention also provides a solution of the gain control type, but which is totally different from that described in particular in the articles by Taniguchi et al. and by Shoham. More precisely, according to an embodiment of the invention, the extraction of the short-term excitation word comprises a linear prediction digital filtering, and the method comprises an updating of the state of the linear prediction filter with the short-term excitation word filtered by a filter whose coefficient or coefficients depend on the value of the long-term gain, in such a way as to weaken the contribution of the short-term excitation when the gain of the long-term excitation is greater than a predetermined threshold, for example equal to 0.8.

Stated otherwise, the solution according to the invention includes weakening the contribution of the short-term excitation if the gain of the long-term excitation is large. However, it is the contribution of the unweakened short-term excitation that is stored in the adaptive dictionary for its updating. Thus, the reduction occurs only on the output. It is important to preserve the short-term contribution to be stored, since the richness of the adaptive dictionary is thus maintained for the lowest frequencies.

Of course, the correction of the gain must also be applied during the reconstruction of the signal at the decoder level. This filter may be of order 0 or else of order greater than or equal to 1. In the latter case, the filter of order greater than or equal to 1 may have a finite impulse response.

According to an embodiment of the invention, in which the filter is of order 1 and has a transfer function equal to $B0+B1\ z^{-1}$, the first coefficient B0 of the filter is equal to $1/(1+\beta.\min(Ga,1))$, and the second coefficient B1 of the filter is equal to $\beta.\min(Ga,1)/(1+\beta.\min(Ga,1))$, where $\beta$ is a real number of absolute value less than 1, Ga is the long-term gain and min(Ga,1) designates the minimum value between Ga and 1.

According to another embodiment of the invention which may be taken in combination or else independently of the previous variation, the extraction of the long-term excitation word is performed using a first perceptual weighting filter comprising a first formantic weighting filter, and the extraction of the short-term excitation word is performed using the first perceptual weighting filter cascaded with a second perceptual weighting filter comprising a second formantic weighting filter. The denominator of the transfer function of the first formantic weighting filter is equal to the numerator of the second formantic weighting filter.

Thus, according to this embodiment, the use of two different formantic weighting filters makes it possible to control the short-term and the long-term distortions independently. The short-term weighting filter is cascaded with the long-term weighting filter. Furthermore, the tying of the denominator of the long-term weighting filter to the numerator of the short-term weighting filter makes it possible to control these two filters separately and furthermore allows a marked simplification when these two filters are cascaded.

Of course, when this embodiment is used in combination with the gain control embodiment, there is provision for an updating of the state of the two perceptual weighting filters with the short-term excitation word filtered by the filter of order greater than or equal to 1.

The subject of the invention is also a wideband speech encoding device comprising sampler/sampling means able to sample the speech in such a way as to obtain successive voice frames each comprising a predetermined number of samples, processor/processing means able with each voice frame, to determine parameters of a code-excited linear prediction model, these processing means comprising first extraction means able to extract a long-term excitation digital word from an adaptive coded directory and to calculate an associated long-term gain, and second extraction means able to extract a short-term excitation word from a fixed coded directory and to calculate an associated short-term gain, and first updating means able to update the adaptive coded directory on the basis of the extracted long-term excitation word and of the extracted short-term excitation word. According to a general characteristic of the invention, the first updating means comprise first calculation means able to sum the product of the long-term excitation extracted word times the associated long-term gain, with the product of the short-term excitation extracted word times the associated short-term gain, in such a way as to deliver a summed digital word, and a low-pass filter having a cutoff frequency greater than a quarter of the sampling frequency and less than a half of the latter, and connected between the output of the first calculation means and the adaptive coded directory in such a way as to update this adaptive directory with the filtered word.

According to one embodiment of the invention, the first extraction means comprise a linear prediction digital filter, and the device comprises second updating means able to perform an updating of the state of the linear prediction filter with the short-term excitation word filtered by a filter whose coefficient or coefficients depend on the value of the long-term gain, in such a way as to weaken the contribution of the short-term excitation when the gain of the long-term excitation is greater than a predetermined threshold.

According to another embodiment of the invention, the first extraction means comprise a first perceptual weighting filter comprising a first formantic weighting filter, the second extraction means comprise the first perceptual weighting filter cascaded with a second perceptual weighting filter comprising a second formantic weighting filter, and the denominator of the transfer function of the first formantic weighting filter is equal to the numerator of the second formantic weighting filter.

The subject of the invention is also a terminal of a wireless communication system, for example a cellular mobile telephone, incorporating a device as defined hereinabove.

BRIEF DESCRIPTION OF THE DRAWINGS

Other advantages and characteristics of the invention will become apparent on examining the detailed description of embodiments and modes of implementation, which are in no way limiting, and the appended drawings, in which.

DETAILED DESCRIPTION OF THE PREFERRED EMBODIMENTS

Figure 1:
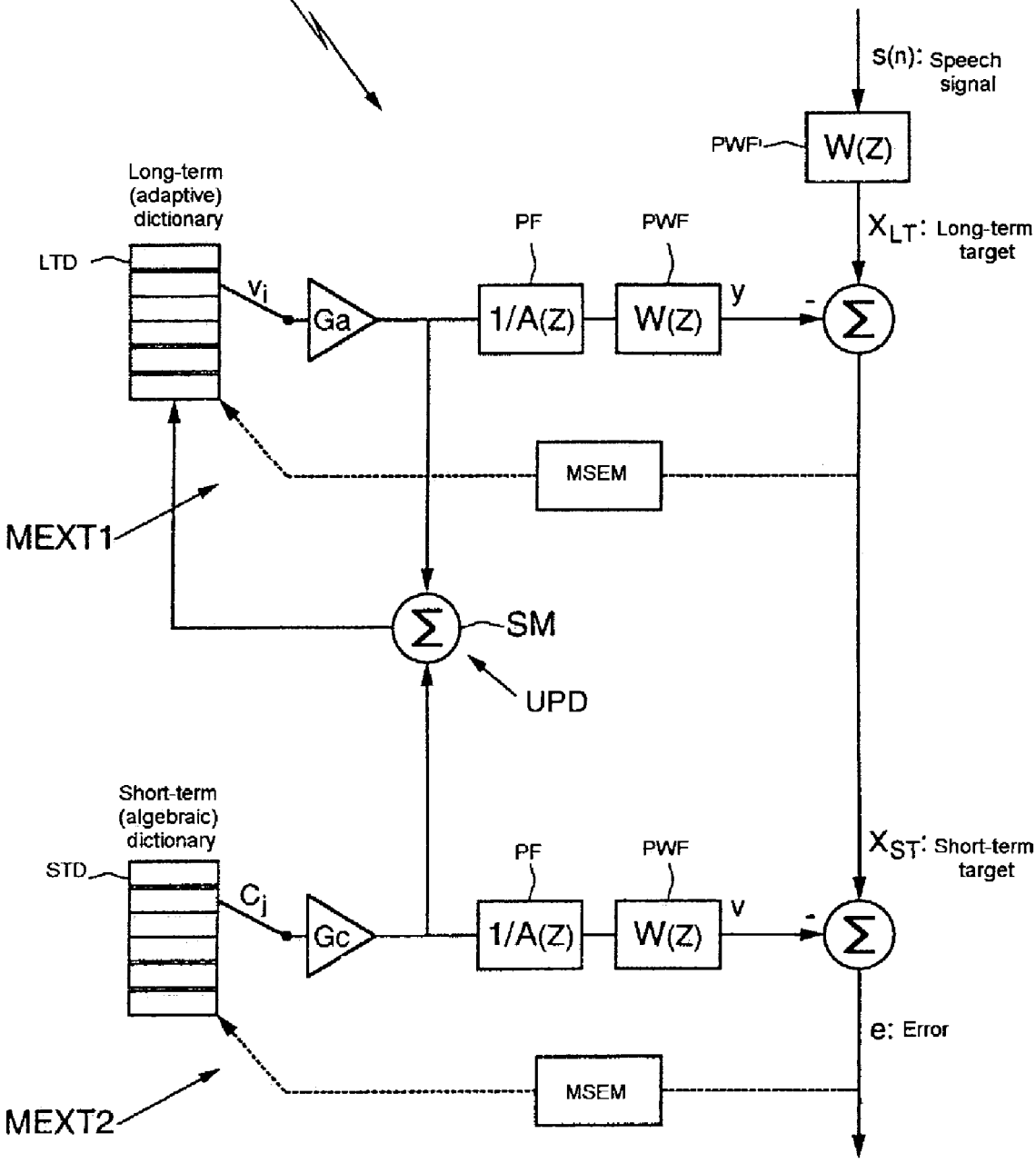
FIG.1 Prior art
FIG. 1, already described, diagrammatically illustrates a speech encoding device, according to the prior art.
Figure 2:
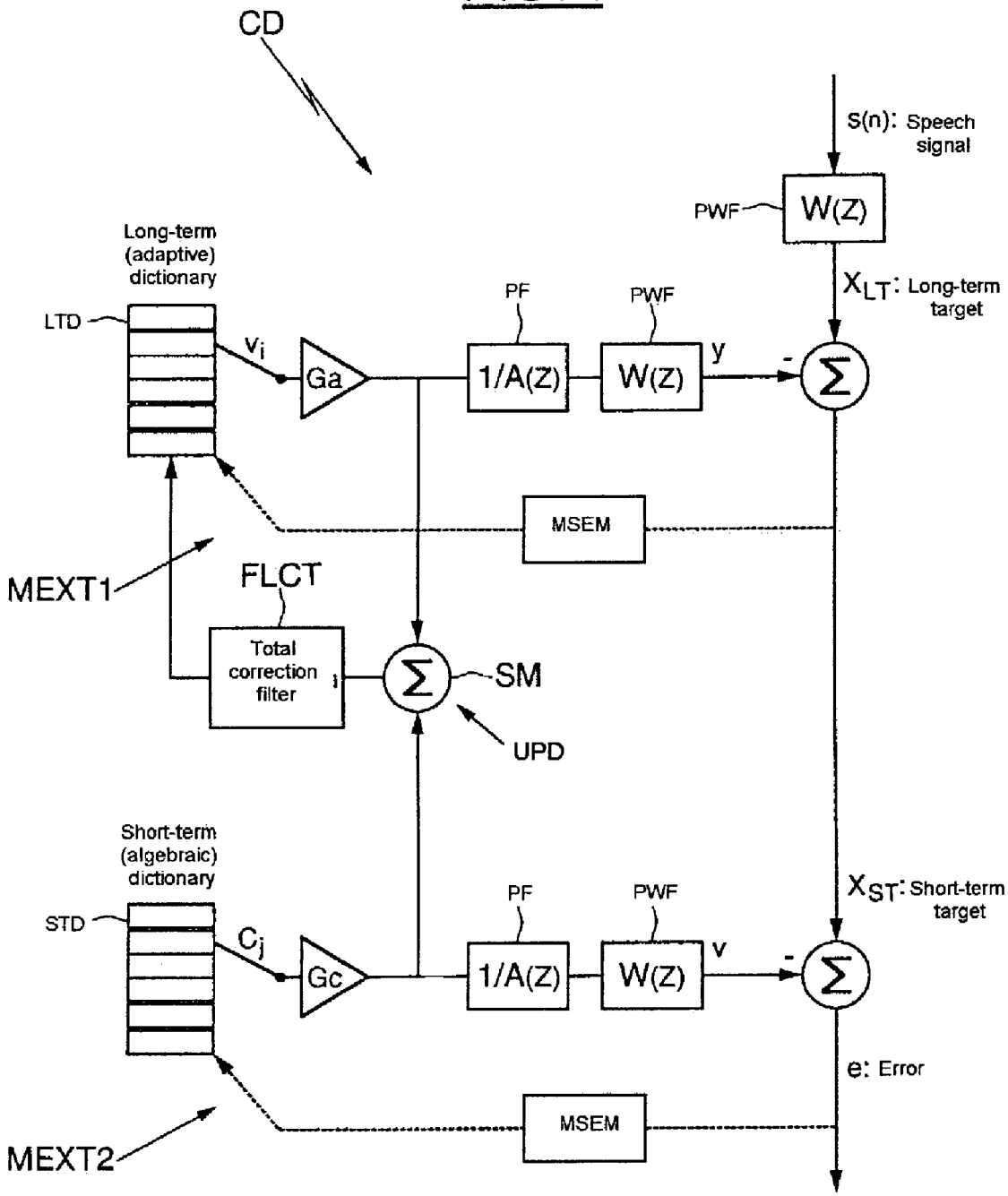
FIG. 2 diagrammatically illustrates a first embodiment of an encoding device, according to the invention.

The encoding device, or coder, CD, according to the invention, as illustrated in FIG. 2, is distinguished from that of the prior art as illustrated in FIG. 1 by the fact that the adaptive means UPD for updating the long-term dictionary LTD comprise a total correction filter FLCT connected between the output of a summator SM and the input of the dictionary LTD. The two inputs of the summator SM respectively receive the product of the long-term excitation extracted word $v_i$ times the associated long-term gain Ga, and the product of the short-term excitation extracted word $c_j$ times the associated gain Gc.

This total correction filter FLCT is a low-pass filter having in a general manner a cutoff frequency greater than a quarter of the sampling frequency and less than a half of the latter. This filter is in the example described a linear-phase finite impulse response digital filter having an order at least equal to 10. More precisely, when the sampling frequency is 16 kHz, use will preferably be made of a cutoff frequency of the order of 6 kHz and a filter of order 20, thereby producing a good compromise between the complexity of the memory and the quality of the reconstructed voice signal.

The harmonic noise is introduced by the contribution of the long-term excitation and by the repeating of samples for values of the fundamental period (pitch) which are less than the length of a speech frame, here 5 ms. This noise is also present for values of the fundamental period that are greater than the size of a frame. It is moreover tied to the adaptive gain, extracted once per speech frame. The use of a low-pass filtering of the long-term contribution is a solution for reducing the harmonic noise.

Additionally, the high-frequency noise is introduced by previous high-frequency contributions of the short-term dictionary, that are present in the adaptive dictionary. To eliminate this high frequency noise, it is possible to eliminate the high-frequency residual components of the adaptive dictionary, by using a correction filter, doing so before reupdating the dictionary.

The total correction filter according to the invention therefore carries out the dual function of harmonic correction and of high frequency correction. This allows an improvement in quality during the voiced speech frames. Furthermore, the placement of this filter, that is to say at the input of the adaptive dictionary, makes it possible to take into account the filtering during the minimization of the error performed when choosing the adaptive excitation of the next speech frame.

Figure 3:
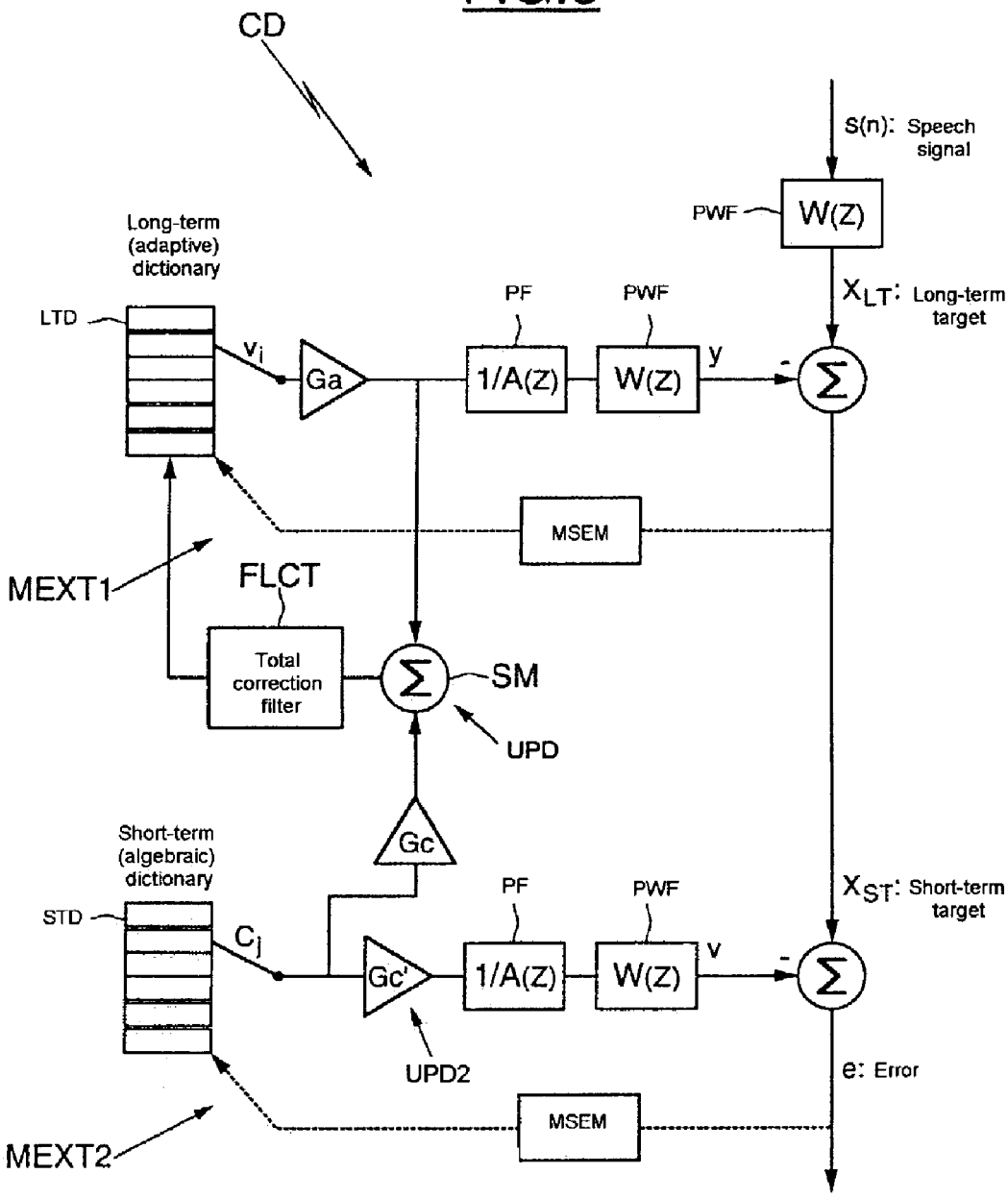
FIG. 3 diagrammatically illustrates a second embodiment of an encoding device, according to the invention, and FIG. 3*a* diagrammatically illustrates an embodiment of a corresponding decoder.

In the embodiment illustrated in FIG. 3, the coder CD furthermore comprises second updating means UPD2 able to perform an updating of the state of the linear prediction filter PF and of the state of the perceptual weighting filter PWF with the short-term excitation word $c_j$ filtered by a filter that has been represented here diagrammatically by a gain Gc'. This filter may be of order 0 and its gain Gc' is less than the gain Gc. As a variant, this filter may have finite impulse response and be of order greater than or equal to 1, with in particular a finite impulse response filter of order 1. The coefficients of this filter of order 1 depend on the value of the long-term gain Ga, in such a way as to weaken the contribution of the short-term excitation when the gain of the long-term excitation Ga is greater than a predetermined threshold, for example equal to 0.8.

The transfer function of this filter is equal to B0+B1 $z^{-1}$. By way of example, the first coefficient of the filter B0 may be determined through the formula (I) hereinbelow.

$$1/(1+0.98\ \min(Ga, 1)) \tag{I}$$

whereas the second coefficient of the filter B1 may be determined through the formula (II) hereinbelow.

$$0.98\ \min(Ga, 1)/(1+0.98\ \min(Ga, 1)) \tag{II}$$

On the other hand it is actually the unweakened short-term contribution (gain Gc) which is stored in the adaptive dictionary LTD for its updating. Thus, the weakening intervenes only on the output signal and by retaining the short-term contribution to be stored it is possible to preserve the richness of the adaptive dictionary for the lowest frequencies.

Figure 3A:
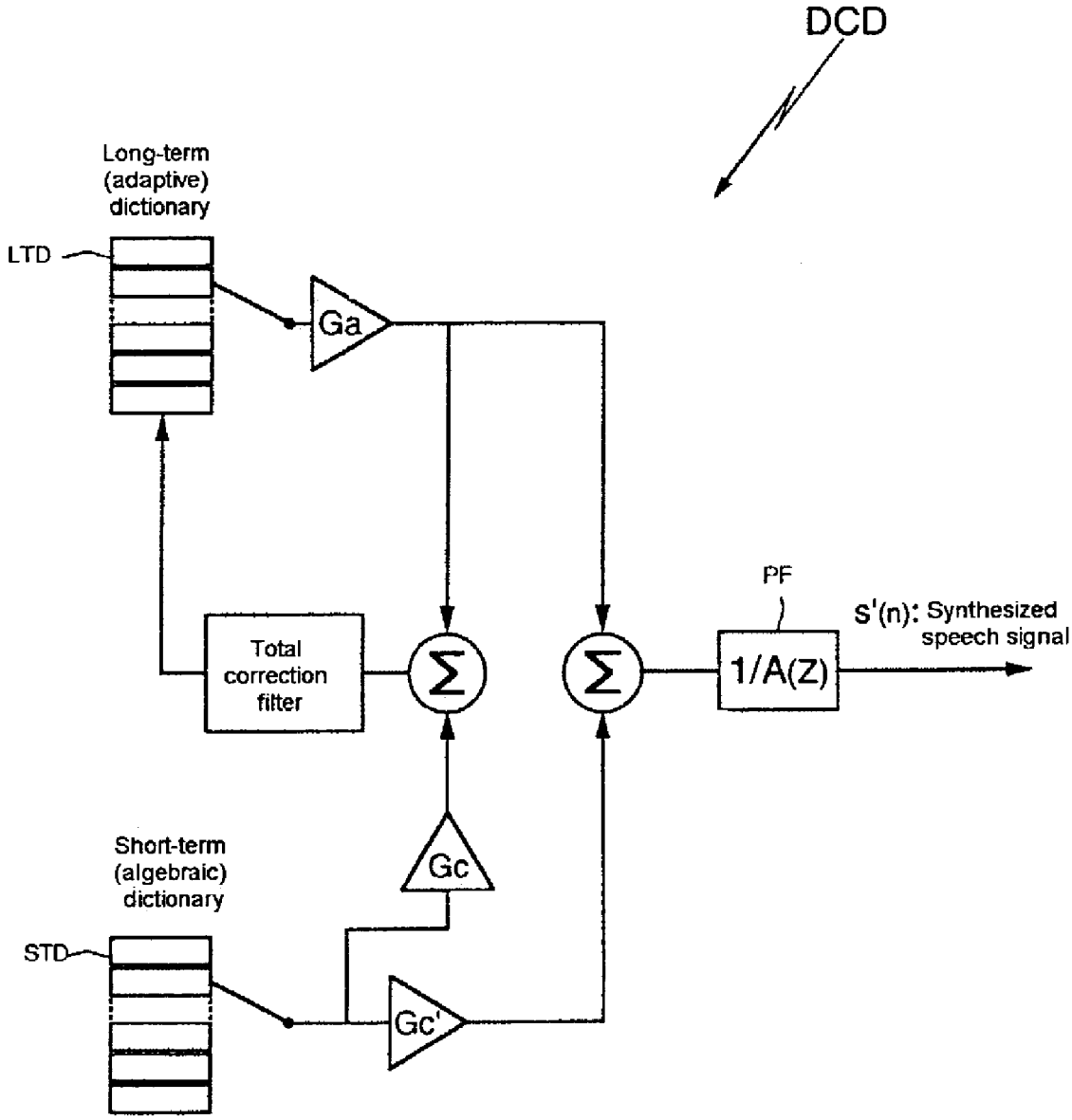

Naturally, the correcting of the gain Gc must also be applied in respect of the updating of the state of the memories of the filters in the decoder DCD, as illustrated diagrammatically in FIG. 3*a*. The variant embodiment illustrated in FIG. 3 makes it possible, in addition to the advantages afforded by the total correction filter, to eliminate the noise of whistling type in the voiced speech frames. The perceptual weighting filter PWF utilizes the masking properties of the human ear with respect to the spectral envelope of the speech signal, the shape of which depends on the resonances of the vocal tract. This filter makes it possible to attribute more importance to the error appearing in the spectral valleys as compared with the formantic peaks.

In the variants illustrated in FIGS. 2 and 3, the same perceptual weighting filter PWF is used for the short-term and long-term search. The transfer function W(z) of this filter PWF is given by the formula (III) hereinbelow.

$$W(z) = \frac{A(z/\gamma_1)}{A(z/\gamma_2)} \tag{III}$$

in which 1/A(z) is the transfer function of the predictive filter PF and γ1 and γ2 are the perceptual weighting coefficients, the two coefficients being positive or zero and less than or equal to 1 with the coefficient γ2 less than or equal to the coefficient γ1. In a general manner, the perceptual weighting filter is constructed from a formantic weighting filter and from a filter for weighting the slope of the spectral envelope of the signal (tilt).

In the present case, it will be assumed that the perceptual weighting filter is formed only from the formantic weighting filter whose transfer function is given by formula (III) above. Now, the spectral nature of the long-term contribution is different from that of the short-term contribution. Consequently, it is advantageous to use two different formantic weighting filters, making it possible to control the short-term and long-term distortions independently.

Figure 4:
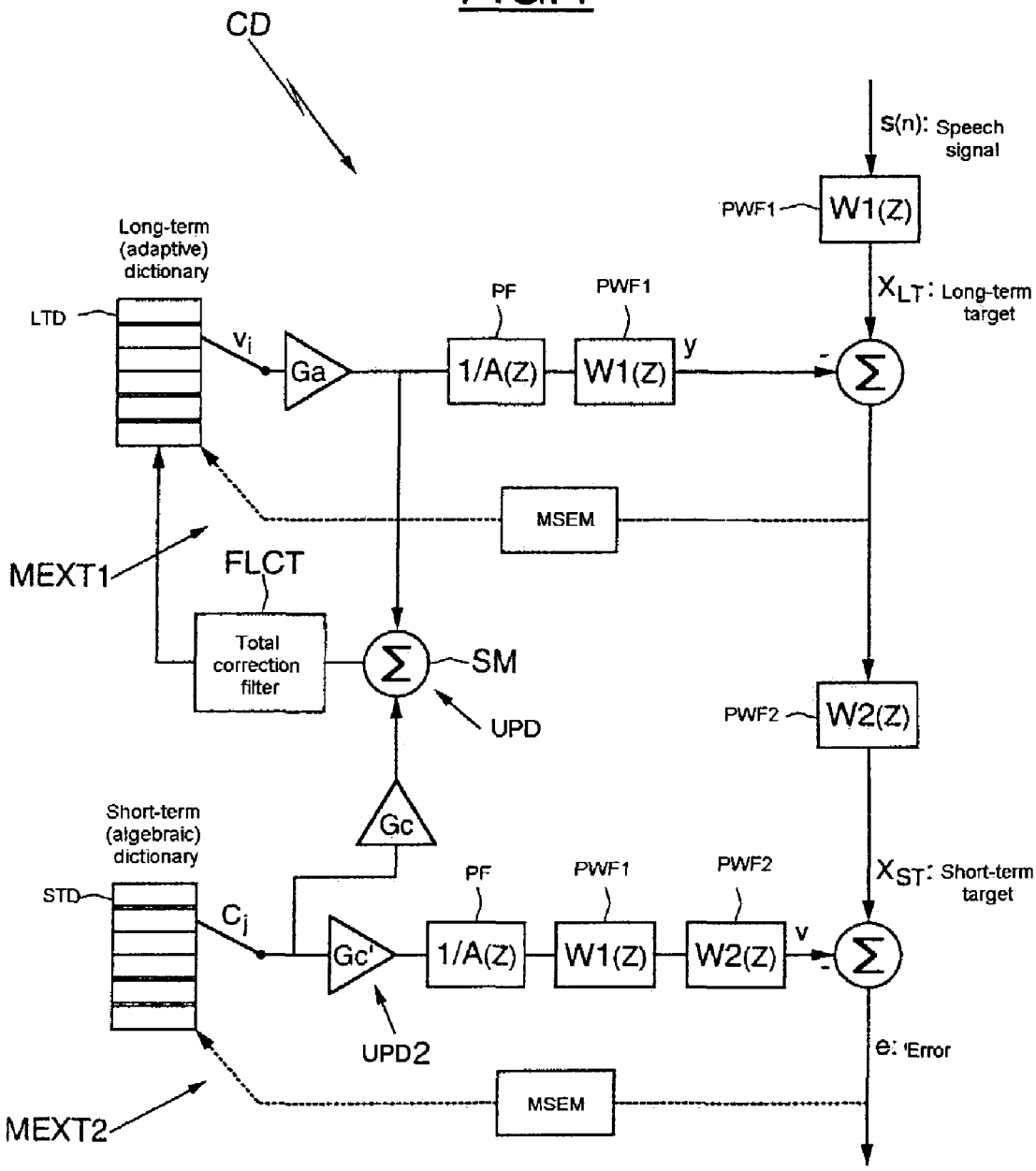
FIG. 4 diagrammatically illustrates a third embodiment of an encoding device, according to the invention.

Such an embodiment is illustrated in FIG. 4, in which, as compared with FIG. 3, the single filter PWF has been replaced by a first formantic weighting filter PWF1 for the long-term search, cascaded with a second formantic weighting filter PWF2 for the short-term search. Since the short-term weighting filter PWF2 is cascaded with the long-term weighting filter, the filters appearing in the long-term search loop must also appear in the short-term search loop. The transfer function $W_1(z)$ of the formantic weighting filter PWF1 is given by formula (IV) hereinbelow.

$$W_1(z) = \frac{A(z/\gamma_{11})}{A(z/\gamma_{12})} \tag{IV}$$

whereas the transfer function $W_2(z)$ of the formantic weighting filter PWF2 is given by formula (V) hereinbelow.

$$W_2(z) = \frac{A(z/\gamma_{21})}{A(z/\gamma_{22})} \tag{V}$$

Additionally, the coefficient $\gamma_{12}$ is equal to the coefficient $\gamma_{21}$. This allows a marked simplification when these two filters are cascaded. Thus, the filter equivalent to the cascade of these two filters has a transfer function given by the formula (VI) hereinbelow.

$$\frac{A(z/\gamma_{11})}{A(z/\gamma_{22})} \tag{VI}$$

Additionally, if one uses the value 1 for the coefficient $\gamma_{11}$, then the synthesis filter PF (having the transfer function 1/A(z)) followed by the long-term weighting filter PWF1 and by the weighting filter PWF2 is then equivalent to the filter whose transfer function is given by the formula (VII) hereinbelow.

$$\frac{1}{A(z/\gamma_{22})} \tag{VII}$$

This further considerably reduces the complexity of the algorithm for extracting the excitations.

By way of indication, it is for example possible to use the respective values 1; 0.1 and 0.9 for the coefficients $\gamma_{11}$, $\gamma_{21}=\gamma_{12}$ and $\gamma_{22}$. Of course, the variant envisaging the use of two different formantic filters may be used independently of that envisaging the weakening of the short-term contribution.

Figure 5:
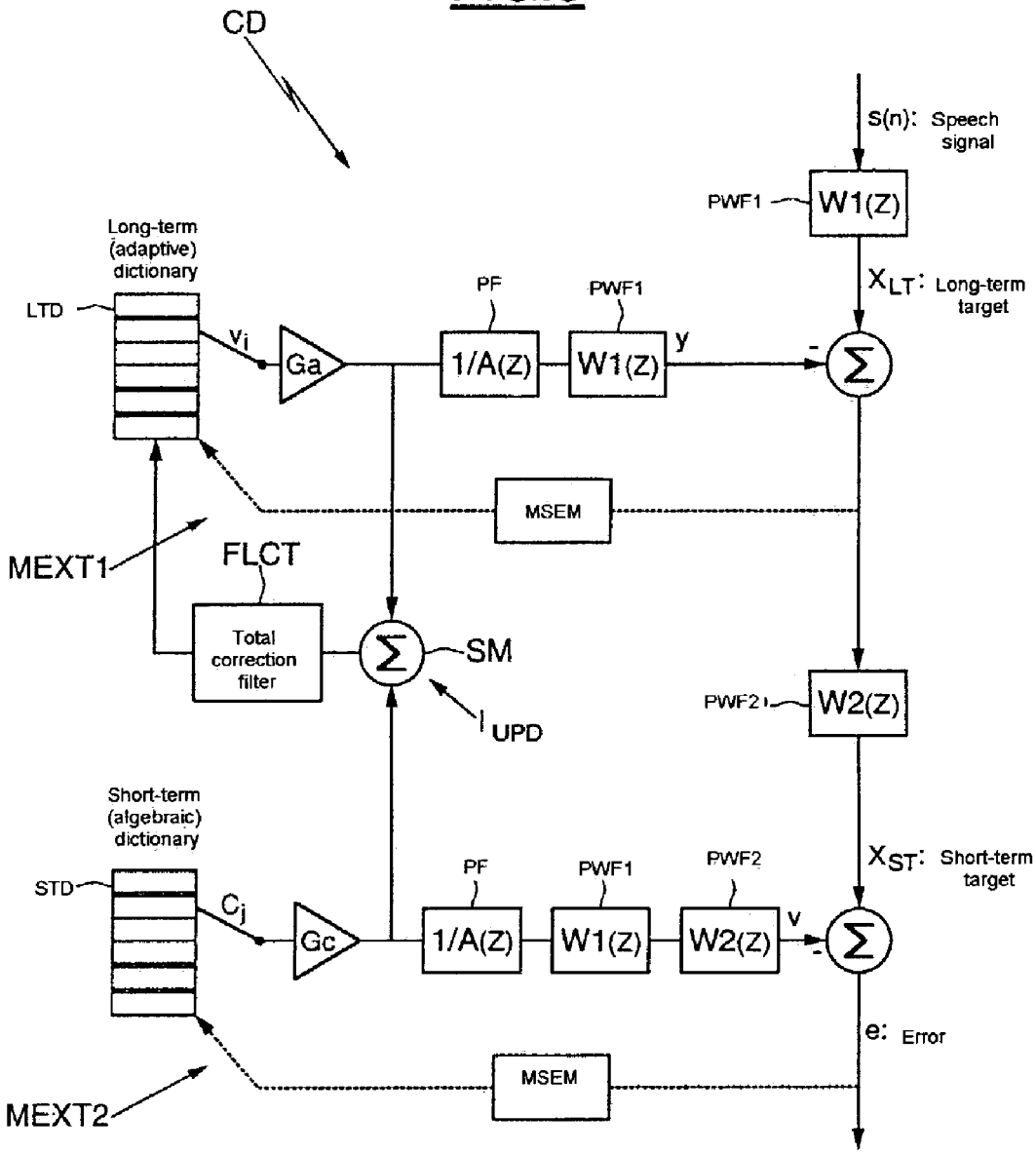
FIG. 5 diagrammatically illustrates a fourth embodiment of an encoding device, according to the invention.

Such an embodiment is illustrated in FIG. 5, where it may be seen that the use of the two formantic filters is taken in combination with the use of the total correction filter.

Figure 6:
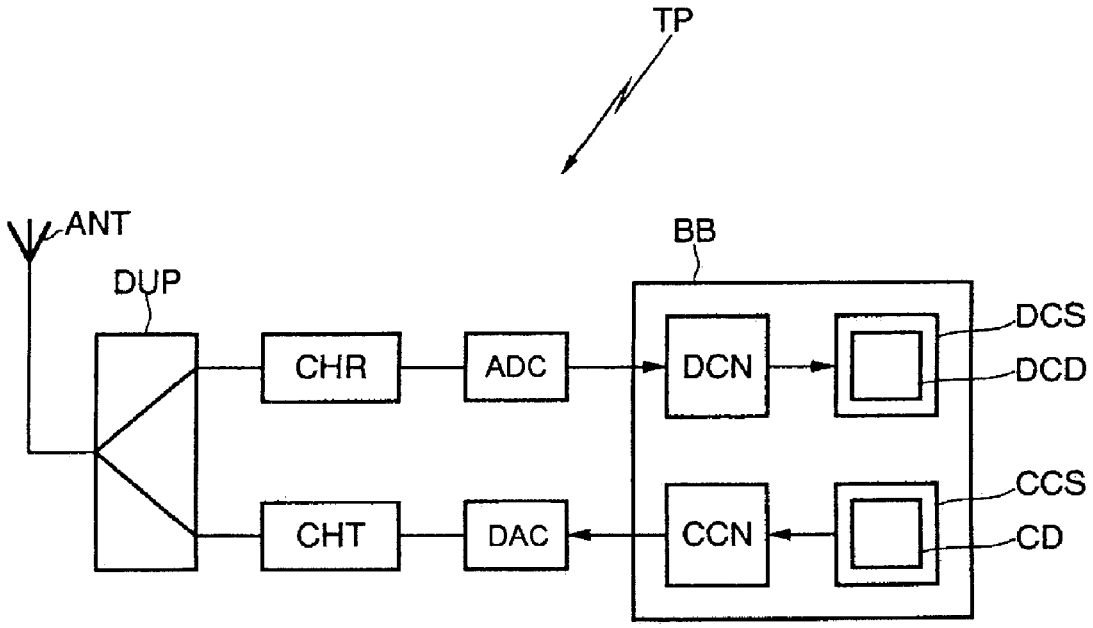
FIG. 6 diagrammatically illustrates the internal architecture of a cellular mobile telephone incorporating a coding device, according to the invention.

The invention applies advantageously to mobile telephones, and in particular to any remote terminals belonging to a wireless communication system. Such a terminal, for example a mobile telephone TP, such as illustrated in FIG. 6, conventionally comprises an antenna linked by way of a duplexer DUP to a reception chain CHR and to a transmission chain CHT. A baseband processor BB is linked respectively to the reception chain CHR and to the transmission chain CHT by way of analogue digital and digital analogue converters ADC and DAC.

Conventionally, the processor BB performs baseband processing, and in particular a channel decoding DCN, followed by a source decoding DCS. For transmission, the processor performs a source coding CCS followed by a channel coding CCN. When the mobile telephone incorporates a coder according to the invention, the latter is incorporated within the source coding means CCS, whereas the decoder is incorporated within the source decoding means DCS.

That which is claimed is:

1. A wideband speech encoding method comprising:

sampling the speech to obtain successive voice frames each comprising a predetermined number of samples, and each voice frame having determined parameters of a code-excited linear prediction model, the parameters comprising a long-term excitation digital word extracted from an adaptive coded directory, and an associated long-term gain, and a short-term excitation word extracted from a fixed coded directory and an associated short-term gain; and updating the adaptive coded directory on the basis of the extracted long-term excitation word and of the extracted short-term excitation word, and comprising adding the product of the long-term excitation digital word times the associated long-term gain with the product of the short-term excitation word times the associated short-term gain to generate a summed digital word, and filtering the summed digital word with a low-pass filter having a cutoff frequency greater than a quarter and less than a half of a sampling frequency to obtain a filtered word, and updating the adaptive coded directory with the filtered word.

2. The method according to claim 1, wherein the low-pass filter comprises a linear-phase finite impulse response digital filter having an order of at least 10.

3. The method according to claim 2, wherein the sampling frequency is 16 kHz, and the filter has an order of 20 having a cutoff frequency of the order of 6 kHz.

4. The method according to claim 1, further comprising:

extracting the short-term excitation word with a linear prediction digital filter; and updating of a state of the linear prediction filter with the short-term excitation word filtered by a filter having at least a coefficient depend on the value of the long-term gain, in such a way as to lessen a contribution of the short-term excitation when the gain of the long-term excitation is greater than a predetermined threshold.

5. The method according to claim 4, wherein the predetermined threshold is 0.8.

6. The method according to claim 5, wherein the filter is of order 1 and has a transfer function equal to $B0+B1\ z^{-1}$, and a first coefficient B0 of the filter is equal to $1/(1+\beta.\min(Ga, 1))$, and the second coefficient B1 of the filter is equal to $\beta.\min(Ga, 1)/(1+\beta.\min(Ga, 1))$, where $\beta$ is a real number of absolute value less than 1, Ga is the long-term gain and min(Ga, 1) designates the minimum value between Ga and 1.

7. The method according to claim 6, further comprising:

extracting the long-term excitation word using a first perceptual weighting filter comprising a first formantic weighting filter; and extracting the short-term excitation word using the first perceptual weighting filter cascaded with a second perceptual weighting filter comprising a second formantic weighting filter, the denominator of a transfer function of the first formantic weighting filter being equal to the numerator of a transfer function of the second formantic weighting filter.

8. A method according to claim 7 further comprising updating a state of the first and second perceptual weighting filters with the short-term excitation word filtered by the filter of order 1.

9. The method according to claim 1, further comprising:

extracting the long-term excitation word using a first perceptual weighting filter comprising a first formantic weight filter; and extracting the short-term excitation word using the first perceptual weighting filter cascaded with a second perceptual weighting filter comprising a second formantic weighting filter, the denominator of a transfer function of the first formantic weighting filter being equal to the numerator of a transfer function of the second formantic weighting filter.

10. A wideband speech encoding method comprising:

sampling the speech to obtain successive voice frames each comprising a predetermined number of samples, and each voice frame having parameters of a code-excited linear prediction model, the parameters comprising a long-term excitation digital word extracted from an adaptive coded directory, and, an associated long-term gain, and a short-term excitation word extracted from a fixed coded directory and, an associated short-term gain; and updating the adaptive coded directory on the basis of the extracted long-term excitation word and of the extracted short-term excitation word, and comprising adding the product of the long-term excitation digital word times the associated long-term gain with the product of the short-term excitation word times the associated short-term gain to generate a summed digital word, and filtering the summed digital word to obtain a filtered word, and updating the adaptive coded directory with the filtered word.

11. The method according to claim 10, wherein the summed digital word is filtered with a low-pass filter comprising a linear-phase finite impulse response digital filter having an order of at least 10.

12. The method according to claim 11, wherein the sampling frequency is 16 kHz, and the filter has an order of 20 having a cutoff frequency of the order of 6 kHz.

13. The method according to claim 10, further comprising:

extracting the short-term excitation word with a linear prediction digital filter; and updating of a state of the linear prediction filter with the short-term excitation word filtered by a filter having at least a coefficient depend on the value of the long-term gain, in such a way as to lessen a contribution of the short-term excitation when the gain of the long-term excitation is greater than a predetermined threshold.

14. The method according to claim 13, wherein the predetermined threshold is 0.8.

15. The method according to claim 14, wherein the filter is of order 1 and has a transfer function equal to B0+B1 $z^{-1}$, and a first coefficient B0 of the filter is equal to 1/(1+β.min (Ga, 1)), and the second coefficient B1 of the filter is equal to β.min(Ga, 1)/(1+β.min(Ga, 1)), where β is a real number of absolute value less than 1, Ga is the long-term gain and min(Ga, 1) designates the minimum value between Ga and 1.

16. The method according to claim 15, further comprising:

extracting the long-term excitation word using a first perceptual weighting filter comprising a first formantic weighting filter; and extracting the short-term excitation word using the first perceptual weighting filter cascaded with a second perceptual weighting filter comprising a second formantic weighting filter, the denominator of a transfer function of the first formantic weighting filter being equal to the numerator of a transfer function of the second formantic weighting filter.

17. A method according to claim 16 further comprising updating a state of the first and second perceptual weighting filters with the short-term excitation word filtered by the filter of order 1.

18. The method according to claim 10, further comprising:

extracting the long-term excitation word using a first perceptual, weighting filter comprising a first formantic weighting filter; and extracting the short-term excitation word using the first perceptual weighting filter cascaded with a second perceptual weighting filter comprising a second formantic weighting filter, the denominator of a transfer function of the first formantic weighting filter being equal to the numerator of a transfer function of the second formantic weighting filter.

19. A wideband speech encoding device comprising:

sampling means for sampling the speech to obtain successive voice frames each comprising a predetermined number of samples;

processing means for determining parameters of a code-excited linear prediction model with each voice frame, and comprising first extraction means for extracting a long-term excitation digital word from an adaptive coded directory and calculating an associated long-term gain, and second extraction means for extracting a short-term excitation word from a fixed coded directory and calculating an associated short-term gain; and first updating means for updating the adaptive coded directory on the basis of the extracted long-term excitation word and of the extracted short-term excitation word, and comprising first calculation means for summing the product of the long-term excitation extracted word times the associated long-term gain, with the product of the short-term excitation extracted word times the associated short-term gain, to deliver a summed digital word, and a low-pass filter having a cutoff frequency greater than a quarter and less than a half of a sampling frequency to generate a filtered word, and connected between an output of the first calculation means and the adaptive coded directory to update the adaptive directory with the filtered word.

20. The device according to claim 19, wherein the low-pass filter comprises a linear-phase finite impulse response digital filter having an order of at least 10.

21. The device according to claim 20, wherein the sampling frequency is 16 kHz, and the linear-phase finite impulse response digital filter has an order 20 and a cutoff frequency of the order of 6 kHz.

22. The device according to claims 19 wherein the first extraction means comprises a linear prediction digital filter; and further comprising second updating means for updating of a state of the linear prediction filter with the short-term excitation word filtered by a filter having at least a coefficient dependent on the value of the long-term gain, in such a way as to lessen a contribution of the short-term excitation when the gain of the long-term excitation is greater than a predetermined threshold.

23. The device according to claim 22, wherein the predetermined threshold is 0.8.

24. The device according to claim 23, wherein the filter is of order 1 and has a transfer function equal to B0+B1 $z^{-1}$, and a first coefficient B0 of the filter is equal to 1/(1+β.min (Ga, 1)), and a second coefficient B1 of the filter is equal to β.min(Ga, 1)/(1β.min(Ga, 1)), where β is a real number of absolute value less than 1, Ga is the long-term gain and min(Ga, 1) designates the minimum value between Ga and 1.

25. The device according to claim 24, wherein the first extraction means comprises a first perceptual weighting filter comprising a first formantic weighting filter, the second extraction means comprises the first perceptual weighting filter cascaded with a second perceptual weighting filter comprising a second formantic weighting filter, and the denominator of a transfer function of the first formantic weighting filter is equal to the numerator of a transfer function of the second formantic weighting filter.

26. The device according to claim 25, wherein the second updating means updates a state of the two perceptual weighting filters with the short-term excitation word filtered by the filter of order 1.

27. A wideband speech encoding device comprising:

a sampler to sample the speech to obtain successive voice frames each comprising a predetermined number of samples;

a processor to determine parameters of a code-excited linear prediction model with each voice frame, and comprising a first extractor to extract a long-term excitation digital word from an adaptive coded directory and calculate an associated long-term gain, and a second extractor to extract a short-term excitation word from a fixed coded directory and calculate an associated short-term gain; and a first updating unit to update the adaptive coded directory on the basis of the extracted long-term excitation word and of the extracted short-term excitation word, and comprising a first calculation unit to add the product of the long-term excitation extracted word times the associated long-term gain, with the product of the short-term excitation extracted word times the associated short-term gain, to deliver a summed digital word, and a low-pass filter to generate a filtered word, and connected between an output of the first calculation unit and the adaptive coded directory to update the adaptive coded directory with the filtered word.

28. The device according to claim 27, wherein the low-pass filter comprises a linear-phase finite impulse response digital filter having an order of at least 10.

29. The device according to claim 28, wherein the sampling frequency is 16 kHz, and the linear-phase finite impulse response digital filter has an order 20 and a cutoff frequency of the order of 6 kHz.

30. The device according to claims 27 wherein the first extraction unit comprises a linear prediction digital filter; and further comprising a second updating unit to update a state of the linear prediction filter with the short-term excitation word filtered by a filter having at least a coefficient dependent on the value of the long-term gain, in such a way as to lessen a contribution of the short-term excitation when the gain of the long-term excitation is greater than a predetermined threshold.

31. The device according to claim 30, wherein the predetermined threshold is 0.8.

32. The device according to claim 31, wherein the filter is of order 1 and has a transfer function equal to $B0+B1\ z^{-1}$, and a first coefficient B0 of the filter is equal to $1/(1+\beta.\min(Ga, 1))$, and a second coefficient B1 of the filter is equal to $\beta.\min(Ga, 1)/(1+\beta.\min(Ga, 1))$, where β is a real number of absolute value less than 1, Ga is the long-term gain and min(Ga, 1) designates the minimum value between Ga and 1.

33. The device according to claim 32, wherein the first extraction unit comprises a first perceptual weighting filter comprising a first formantic weighting filter, the second extraction unit comprises the first perceptual weighting filter cascaded with a second perceptual weighting filter comprising a second formantic weighting filter, and the denominator of a transfer function of the first formantic weighting filter is equal to the numerator of a transfer function of the second formantic weighting filter.

34. The device according to claim 33, wherein the second updating unit updates a state of the two perceptual weighting filters with the short-term excitation word filtered by the filter of order 1.

35. A terminal of a wireless communication system, comprising a device according to claim 27.

36. The terminal according to claim 35, wherein the terminal defines a mobile telephone.

* * * * *

UNITED STATES PATENT AND TRADEMARK OFFICE

CERTIFICATE OF CORRECTION

PATENT NO. : 7,254,534 B2
APPLICATION NO. : 10/622021
DATED : August 7, 2007
INVENTOR(S) : Ansorge et al.

It is certified that error appears in the above-identified patent and that said Letters Patent is hereby corrected as shown below:

| | |
|---|---|
| Column 10, Line 19 | Delete: "weight"<br>Insert: -- weighting -- |
| Column 10, Lines 33 and 35 | Delete: "and,"<br>Insert: -- and -- |
| Column 11, Line 28 | Delete: "perceptual,"<br>Insert: -- perceptual -- |
| Column 12, Line 20 | Delete: "1β.min"<br>Insert: -- 1 + β.min -- |

Signed and Sealed this

Twenty-ninth Day of April, 2008

JON W. DUDAS
*Director of the United States Patent and Trademark Office*